United States Patent [19]

Lokander et al.

[11] Patent Number: 4,776,263

[45] Date of Patent: Oct. 11, 1988

[54] DEVICE FOR A SUSPENDED CEILING STRUCTURE FOR RECTANGULAR FILTER ELEMENTS

[75] Inventors: John E. Lokander, Kolmården; Sören Andersson, Norrköping, both of Sweden

[73] Assignee: Fläkt Aktiebolag, Stockholm, Sweden

[21] Appl. No.: 868,517

[22] Filed: May 30, 1986

[30] Foreign Application Priority Data

Jun. 14, 1985 [SE] Sweden ..... 8502964

[51] Int. Cl.[4] ..... F24F 13/08

[52] U.S. Cl. ..... 98/40.07; 55/484; 55/385.2; 98/40.12

[58] Field of Search ..... 98/40.01, 40.07, 40.08, 98/40.1, 40.11, 40.12, 40.2, 40.24; 55/385 A, 484

[56] References Cited

U.S. PATENT DOCUMENTS 3,001,464 9/1961 Moore ..... 55/484
3,166,001 1/1965 Person et al. ..... 98/40.11
3,173,616 3/1965 Lipscomb ..... 98/40.07 X
3,254,587 6/1966 Sweeney ..... 98/40.12
4,178,159 12/1979 Fecteau ..... 55/484 X
4,616,558 10/1986 Ball et al. ..... 98/40.11

*Primary Examiner*—Harold Joyce
*Attorney, Agent, or Firm*—Oblon, Fisher, Spivak, McClelland & Maier

[57] ABSTRACT

A device for a suspended ceiling structure (1) for rectangular filter elements (2, 3). Some filter elements are located at a distance from each other to allow the suspension of light fittings from the suspended ceiling structure. An air stream is forced to flow out from the filter elements in the direction downwards towards the floor and vanes (8, 9) are then arranged substantially at the same level as and adjacent to at least one of those lateral surfaces of the fitting, which face the filter elements. The vanes are arranged at an angle to the air stream in such a way that the air is deflected and is made to flow towards a region (10) immediately below the light fitting.

4 Claims, 3 Drawing Sheets

DEVICE FOR A SUSPENDED CEILING STRUCTURE FOR RECTANGULAR FILTER ELEMENTS

BACKGROUND OF THE INVENTION

The present invention relates to a device for a suspended cealing structure for rectangular filter elements, wherein at least some filter elements are located at a distance from each other in order to allow therebetween the suspension of objects such as light fittings or the like from the suspended ceiling structure and in addition an air stream is arranged to flow out through the filter elements and downwards towards the floor.

Suspended ceiling structures of the above mentioned type are above all used in clean rooms in which turbulence problems caused, for instance by light fittings, has caused great problems, since particles are captured and forced to circulate within a region immediately below the lamp, so that they can spread uncontrollably in the room. It has been established that in a room with a laminar air flow from the filter element downwards towards the floor, turbulent regions are produced below the light fittings down to a distance from the fitting of approximately three times the width of the fitting. This means that all particles produced in the region flow back upwards towards the ceiling and are mixed with the clean filtered air, whereby the cleanness of the whole room will be heavily impaired.

Until now these problems have been solved by providing a suspended ceiling consisting of a great number of small tubes of plastics or glass material, which are placed on their ends to form a continuous body and the suspended ceiling is composed of these bodies which thereby prevent the occurrence of turbulent regions below the light fittings. However, this solution is extremely expensive as far as the material and the installation is concerned and the object of the present invention is to provide a structure which completely eliminates the need for an extra suspended ceiling and at the same time efficiently prevents the occurrence of turbulent regions below the light fittings or other objects suspended from the ceiling.

SUMMARY OF THE INVENTION

This object is realized according to the invention essentially by the provision of vanes arranged substantially at the same level as and adjacent to at least one of those lateral surfaces of the suspended objects, which face the filter elements, which vanes are arranged at an angle to the air stream to make the air flow towards a region immediately below each of the suspended objects, whereby the occurrence of turbulent regions below the suspended objects is substantially eliminated.

BRIEF DESCRIPTION OF THE DRAWINGS

An exemplary embodiment of the invention will now be described more in detail with reference to the accompanying drawings, in which.

DETAILED DESCRIPTION OF THE PREFERRED EMBODIMENTS

Figure 1:
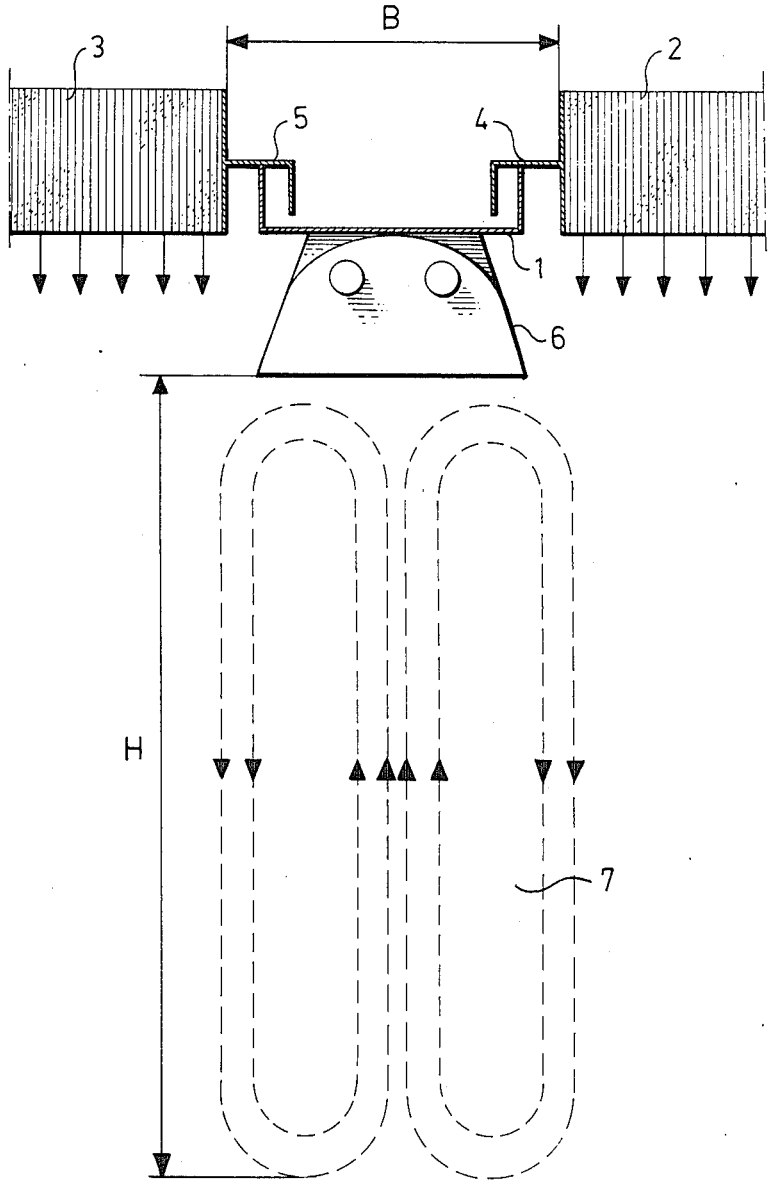
Fig. 1 PRIOR ART
FIG. 1 is a section through a suspended ceiling structure with filter elements and with a light fitting placed between the elements and the turbulent region produced beneath the light fitting.

In FIG. 1 a suspended ceiling structure is shown consisting of U-shaped bars 1, which are suspended from the ceiling (not shown) and which in their turn carry rectangular filter elements 2 and 3, provided with support bars 4 and 5 respectively at their long sides. Between the filter elements and on the lower side of the suspended ceiling bar 1 a light fitting 6 is attached. The distance between the filter elements is denoted by "B" in the figure and the air streams resulting from this suspended ceiling structure are indicated with arrows. The air stream passing through the filters has a laminar flow downwards towards the floor. Below the light fitting 6 there is a region 7 in which turbulence arises and this region has a size substantially corresponding to the width B of the fitting and a height H equal to $B \times 3$. Thus, within this region possible particles are retained and in the interface between the turbulent and the laminar flow these particles can be ejected into the clean filtered air, thereby being spread into the room.

Figure 2:
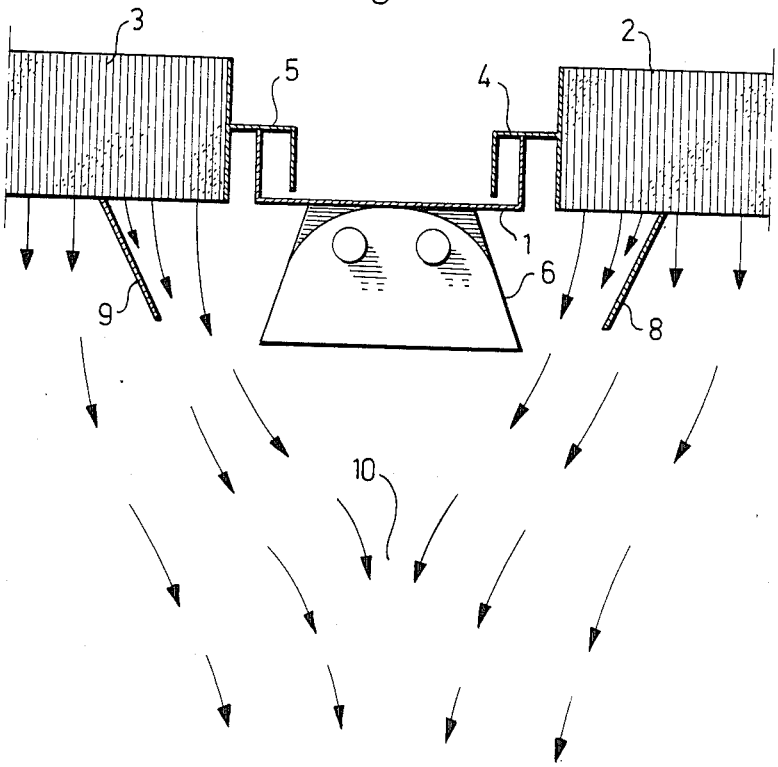
FIG. 2 shows the suspended ceiling structure according to FIG. 1 with a device according to the invention placed on the filter elements and the flow pattern resulting herefrom.

In FIG. 2 a device according to the invention has been installed and in this case it consists of two vanes 8 and 9 arranged at the lower sides of the filter elements 2 and 3 extending essentially parallel to and adjacent to those sides of the light fitting 6 which face the filter elements. The vanes are oriented at an angle to the air stream in order to deflect the air and make it stream towards the region 10 immediately below the light fitting 6. In this way the occurrence of turbulent air streams below the light fitting as described in connection with FIG. 1 is prevented. As a matter of fact, perpendicularly below the light fitting a higher air velocity is attained than in the laminar flow produced beneath the filter elements.

Figure 3:
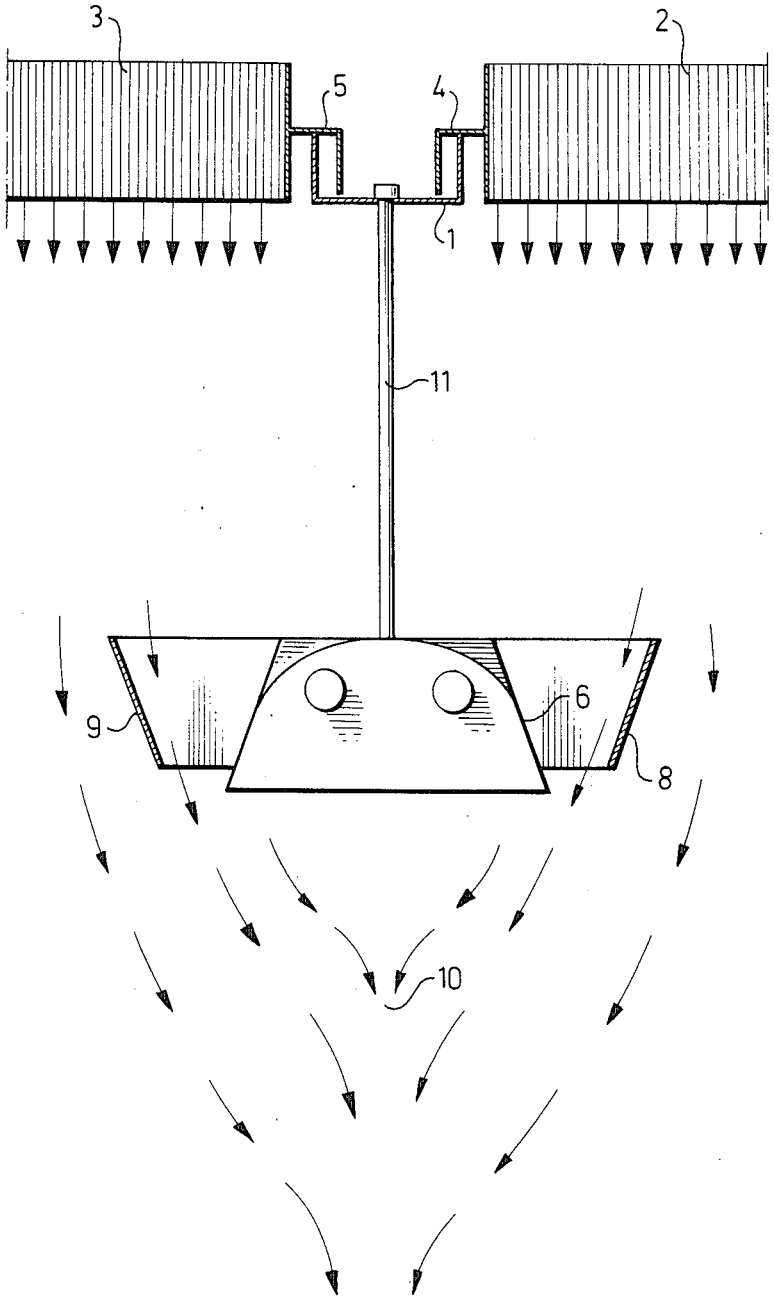
FIG. 3 shows the device according to FIG. 2 adapted to a pendulum suspended light fitting.

FIG. 3 shows how the vanes 8 and 9 may be carried by a light fitting 6 which is suspended in a bar or pendulum 11, whereby the air stream from the filter elements is forced to flow towards the region 10. The width of the U-bar 1 can be made significantly smaller in this case in order to avoid formation of turbulence in the region below the bar.

Figure 4:
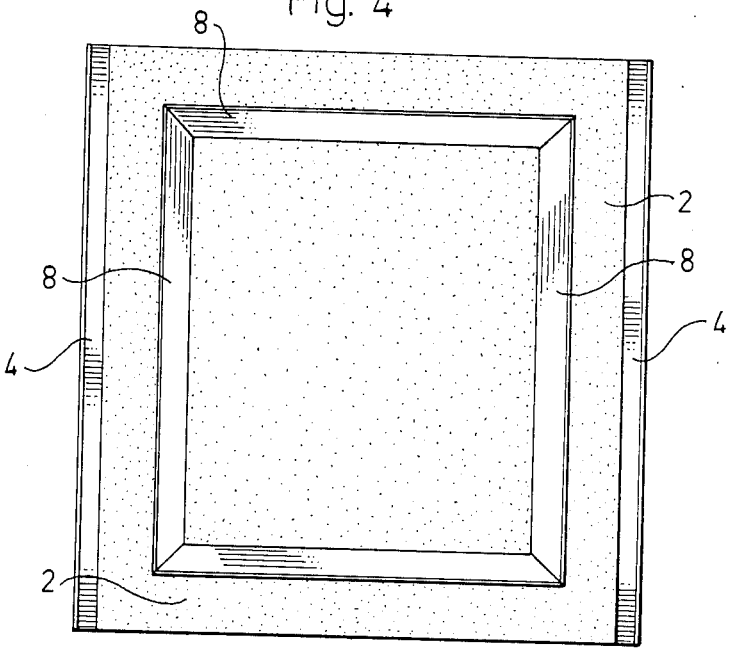
FIG. 4 shows a front view of a filter element with the device according to the invention attached to it.

The vanes can have different shapes and in FIG. 4 an embodiment is shown in which the bars are arranged as a frame positioned within and essentially parallel to the edges of the filter element. The vanes 8 and 9 in FIG. 2 are placed on each side of the light fitting 6, but with an appropriate length and angle to the air stream the technical effect of the invention could be attained if the air stream is deflected by a single vane attached to one of the two filter elements 2 or 3. The angular orientation of the vanes, the distance of the vanes from the light fitting and their length have to be adapted to the air velocities and the air volumes intended for each real installation.

We claim:

1. A device for a suspended ceiling structure for rectangular filter elements, wherein at least some filter elements are located at a distance from each other to allow therebetween the suspension of objects such as light fittings or the like from the suspended ceiling structure and in addition an air stream is forced to flow out through the filter elements and downwards towards the floor, comprising vanes inclined towards said objects and arranged substantially at the same level as and adjacent to at least one of those lateral surfaces of said objects which face said filter elements, said vanes being arranged at such an angle to said air stream as to deflect the air towards a region immediately below each of said suspended objects, whereby the occurrence of turbulent air streams below said suspended objects is substantially eliminated.

2. The device according to claim 1, wherein said vanes are arranged in the form of a frame positioned within and essentially parallel to the edges of said filter element.

3. The device according to claim 1, wherein said vanes are placed at both sides of each said suspended object, whereby the velocity of the air stream immediately below said object is greater than the air velocity below the centre of said filter elements.

4. The device of claim 1, wherein said objects are light fixtures suspended below said ceiling structure and wherein said vanes are fixed to said light fixtures.

* * * * *